US006945296B2

(12) United States Patent
Kunz

(10) Patent No.: US 6,945,296 B2
(45) Date of Patent: Sep. 20, 2005

(54) DEVICE FOR APPLYING A CODE STRIP TO A SUPPORTING STRUCTURE OF AN ELEVATOR

(75) Inventor: René Kunz, Lucerne (CH)

(73) Assignee: Inventio AG, Hergiswil (CH)

( * ) Notice: Subject to any disclaimer, the term of this patent is extended or adjusted under 35 U.S.C. 154(b) by 19 days.

(21) Appl. No.: 10/703,786

(22) Filed: Nov. 6, 2003

(65) Prior Publication Data

US 2004/0129503 A1 Jul. 8, 2004

(30) Foreign Application Priority Data

May 31, 2001 (EP) ..... 01810529

(51) Int. Cl.[7] ..... B32B 35/00
(52) U.S. Cl. ..... 156/391; 156/524
(58) Field of Search ..... 156/71, 307.3, 156/391, 523, 524, 293; 226/196.1; 408/103, 115 R, 115 B, 72 B, 116, 196; 144/253.1, 253.2

(56) References Cited

U.S. PATENT DOCUMENTS 4,597,821 A * 7/1986 Munro ..... 156/500
5,405,471 A * 4/1995 LeMaster ..... 156/202
6,128,116 A 10/2000 Dobler et al.

FOREIGN PATENT DOCUMENTS

DE 3336926 A1 4/1985
DE G9210996 12/1992

* cited by examiner

*Primary Examiner*—Chris Fiorilla
*Assistant Examiner*—Sing P. Chan
(74) *Attorney, Agent, or Firm*—Schweitzer Cornman Gross & Bondell LLP

(57) ABSTRACT

A device for attaching a code strip to a supporting structure of an elevator is in the form of a fitting tool capable of being guided along the supporting structure to play out an extended length of code strip material. The fitting tool has a guide shoe and a strip station mounted to the guide shoe for attaching the code strip to the supporting structure as the fitting tool is slid along the supporting structure, such as a guide rail, by a mechanic.

4 Claims, 3 Drawing Sheets

DEVICE FOR APPLYING A CODE STRIP TO A SUPPORTING STRUCTURE OF AN ELEVATOR

The present invention relates to a device for attaching a code strip to a supporting structure of an elevator, in which a fitting tool is guidedly movable along the supporting structure, the code strip being attachable to the supporting structure by means of the fitting tool. The present application is a continuation of PCT/CH 02/00278.

BACKGROUND OF THE INVENTION

From published patent specification DGM 92 10 996.9 U1 a position-measuring device has become known in which a magnetic head scans a magnetic strip. The magnetic head is arranged on the elevator car, which is guided in the elevator hoistway by means of guide rails. The magnetic strip is arranged on a guide rail and contains information regarding distance, stops, etc. The self-adhesive magnetic strip is constructed with a width such that the magnetic head is always situated over the magnetic strip, even if the magnetic strip is arranged crookedly or laterally offset.

A disadvantage of the known device is that the magnetic strip, positioned by hand, runs crookedly when considered over the height of the hoistway. So that no information is lost when scanning the magnetic strip, the magnetic strip and the magnetic head must be realized sufficiently wide.

BRIEF DESCRIPTION OF THE INVENTION

The present invention sets out to provide a remedy. The invention provides a solution for avoiding the disadvantages of the known device by providing a tool by means of which a code support strip can be attached to a supporting structure precisely over the full height of a hoistway.

The fitting tool incorporates means for allowing the tool to be guided along the structure, such as a guide rail, upon which the code strip is to be mounted. The tool also includes means for properly and precisely aligning the strip with respect to the structure for attachment.

The advantages achieved by the invention include that a strip, such as a magnetic strip, with fine resolution can be used. The strip can be laid straight, allowing a code strip with greater information density to be used. With the fitting tool according to the invention, the code strip can be arranged, for example, on a guide rail without being overstretched. An overstretched or wrinkled code strip would result in distortion of the read information. Furthermore, a finer code strip allows the use of a space-saving, compact, reading head. With the fitting tool according to the invention, the magnetic strip can be fitted in a shorter time, and with an accuracy which is consistently good over the entire height of the hoistway.

BRIEF DESCRIPTION OF THE DRAWINGS

The present invention is described in greater detail with the aid of the attached figures, wherein.

DETAILED DESCRIPTION OF THE INVENTION

Figure 1:
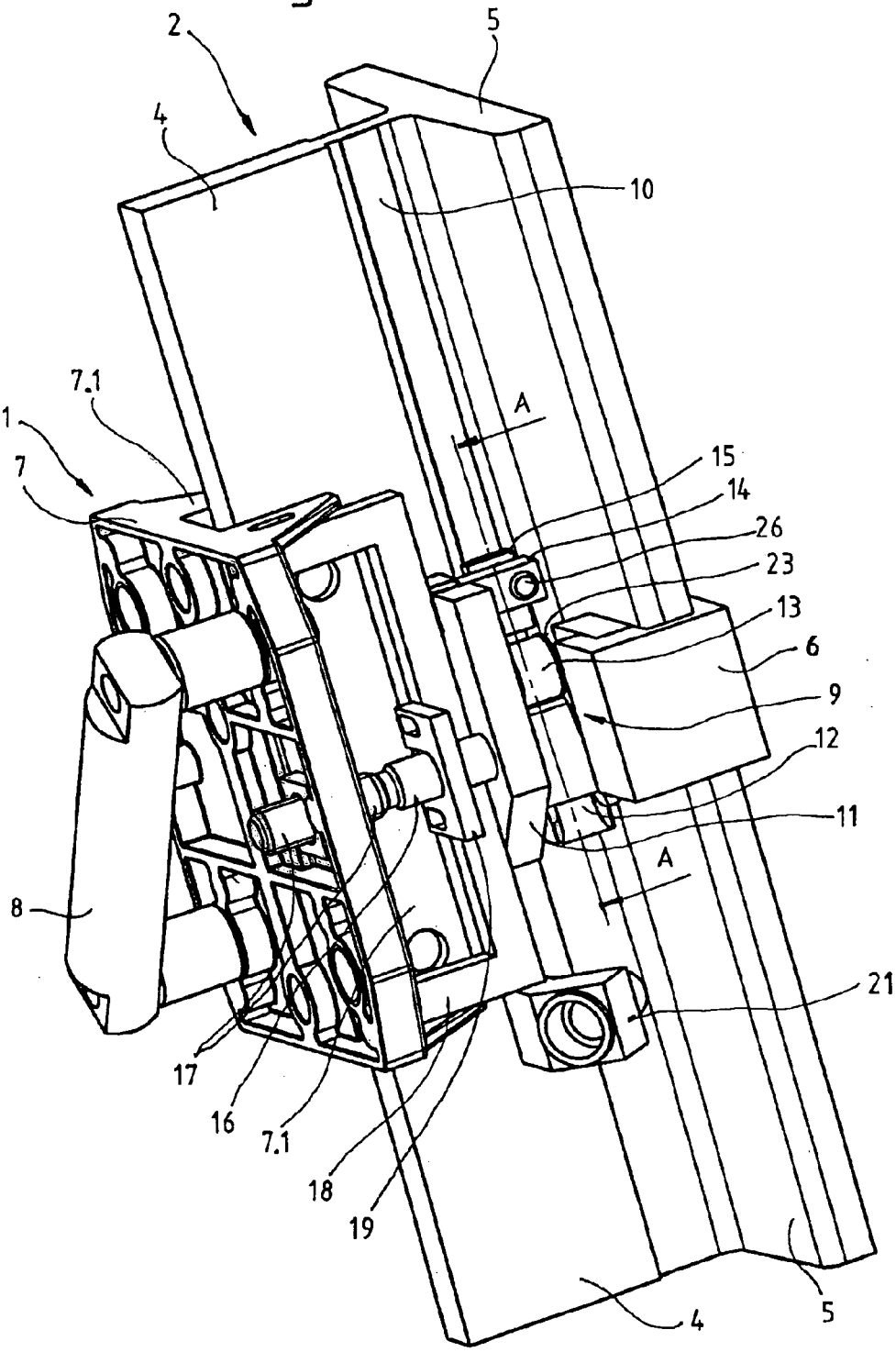
FIG. 1 is a perspective view of the fitting tool according to the invention.

FIG. 1 shows a three-dimensional representation of a fitting tool 1 according to the invention which is movable along, for example, a guide rail 2. The guide rail 2 serves to guide an elevator car for travel in an elevator hoistway. The guide rail 2 comprises a guide limb 4 and a rail base 5, and is fastened by means of, for example, clips 6 to a hoistway wall or to anchor rails.

Figure 2:
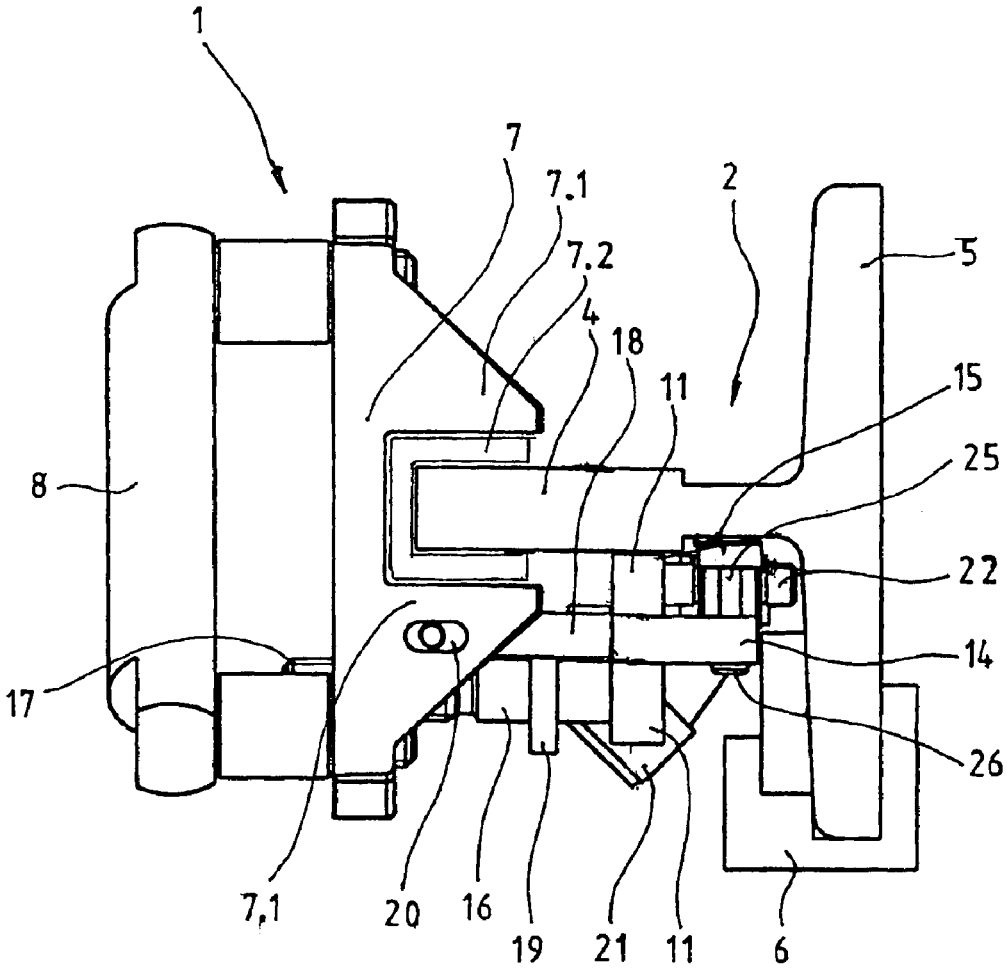
FIG. 2 is an end elevation view of the fitting tool.

The fitting tool 1 consists of a guide shoe 7 with a handle 8 and a strip station 9 for attaching a code strip 10 to the guide limb 4 of the guide rail 2. The guide shoe 7 has, on each side of the guide limb 4, a flange 7.1, whereby a U-shaped space is formed in which a sliding body 7.2 is arranged (see FIG. 2). Arranged on a station-support 11 of the strip station 9 are a strip lead-in 12, a guide roller 13, and an arm 14 with a pressure shoe 15. A connecting pin 16 with adjusting nuts 17 connects the station-support 11 to the guide shoe 7, the connecting pin 16 being supported in a bearing on a support 19 connected to a bracket 18. Arranged on the bracket 18, which is detachably connected to the guide shoe 7 and which has pins that allow the bracket 18 to be moved within elongated holes 20 arranged above and below, is a holder 21 to which a container with adhesive for the code strip 10 can be attached. The holder 21 can also be arranged on the station-support 11.

The guide roller 13, arranged on a roller axle 22, has on each of its end-faces a flange-like disk 23 by means of which the code strip 10 is laterally guided. The roller axle 22 is arranged on the station support 11. The arm 14 with spring bolt 25 arranged on the station support 11 carries the pressure shoe 15. The press-on force for the code strip 10 applied by the pressure shoe can be adjusted by means of an adjusting screw 26.

The fitting work for the code strip 10 takes place, for example, from the roof of an elevator car. The code strip 10 is arranged loosely in the elevator hoistway or is kept available as a roll on the car roof. The fitting tool 1 is placed on the guide limb of the guide rail 2 at the upper end of the guide rail, and the strip station 9 is adjusted into position by means of the adjusting nuts 17. The bracket 18 is correspondingly adapted by means of the elongated holes 20. The container with the adhesive is then arranged. If the code strip 10 is magnetically self-adhesive, no adhesive is necessary. The movability of the bracket 18 serves to adapt the fitting tool to different rail sizes, and to compensate for rail tolerances.

Figure 4:
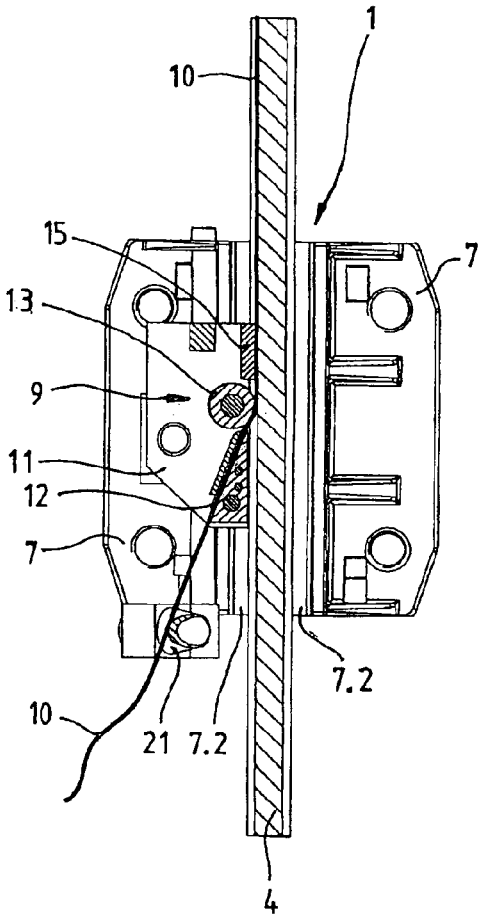
FIG. 4 is a cross-section along the line A—A of FIG. 1 or FIG. 3.
Figure 3:
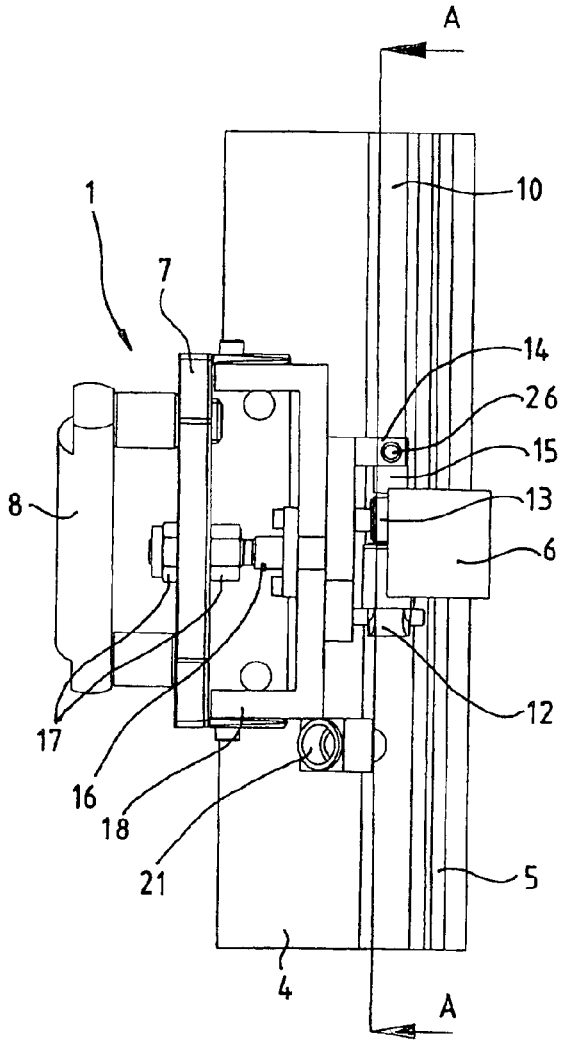
FIG. 3 a side elevation view of the fitting tool.

The code strip 10 is laid in the strip lead-in 12, pushed under the guide roller 13, and pulled under the pressure shoe 15. FIG. 4 shows the path of the code strip 10 in the strip station 9. The mechanic standing on the car roof holds the end of the code strip 10 firmly with his hand and moves the fitting tool 1 downward until the code strip 10 adheres to the adhesive, applied to the guide limb 4, or adheres to the guide limb 4 itself through its own magnetism. The fitting tool 1 is then moved steadily further downward with both hands and the elevator car caused to move downward until the entire height of the elevator hoistway has been traveled.

Instead of the guide rail 2 serving as supporting structure for the code strip 10, other rails or supports in the elevator hoistway can be used.

I claim:

1. A device for attaching a code strip to a supporting structure of an elevator, comprising a fitting tool having a guide shoe having a u-shape flange to embrace multiple sides of a protruding portion of the supporting structure for guidedly moving the tool along the supporting structure; a strip station adjustably mounted to the guide shoe for aligning the code strip independently from the guide shoe for attachment to the supporting structure by means of the fitting tool, and a connecting pin for adjusting the position of the strip station to vary the attachment location for the code strip to the supporting structure in a direction perpendicular to a direction of movement of the guide shoe along the supporting structure.

2. The device according to claim 1, wherein the strip station has a station-support connected to the guide shoe on which a strip lead-in and guide roller for guiding the code strip, and a pressure shoe for attaching the code strip to the supporting structure, are arranged.

3. The device according to claim 2, wherein the pressure shoe is arranged adjustably on an arm of the station-support.

4. The device according to claim 2, further comprising a holder for a container with adhesive for the code strip.

* * * * *